US010497530B2

(12) United States Patent
Feigelson et al.

(10) Patent No.: US 10,497,530 B2
(45) Date of Patent: Dec. 3, 2019

(54) THERMIONIC TUNGSTEN/SCANDATE CATHODES AND METHODS OF MAKING THE SAME

(71) Applicant: The Government of the United States of America, as represented by the Secretary of the Navy, Arlington, VA (US)

(72) Inventors: Boris N. Feigelson, Springfield, VA (US); James A. Wollmershauser, Alexandria, VA (US); Kedar Manandhar, Alexandria, VA (US)

(73) Assignee: The Government of the United States of America, as represented by the Secretary of the Navy, Washington, DC (US)

( * ) Notice: Subject to any disclaimer, the term of this patent is extended or adjusted under 35 U.S.C. 154(b) by 904 days.

(21) Appl. No.: 15/093,853

(22) Filed: Apr. 8, 2016

(65) Prior Publication Data

US 2016/0300684 A1 Oct. 13, 2016

Related U.S. Application Data

(60) Provisional application No. 62/145,827, filed on Apr. 10, 2015.

(51) Int. Cl.
*B22F 3/26* (2006.01)
*H01J 9/04* (2006.01)
(Continued)

(52) U.S. Cl.
CPC ..... *H01J 9/042* (2013.01); *B22F 1/02* (2013.01); *H01J 1/144* (2013.01); *H01J 1/146* (2013.01); *B22F 2998/10* (2013.01)

(58) Field of Classification Search
CPC .. H01J 9/042; H01J 1/142; H01J 1/144; H01J 1/146; B22F 1/02; B22F 3/26; B22F 2998/10; B22F 2999/00
(Continued)

(56) References Cited

U.S. PATENT DOCUMENTS 3,041,209 A * 6/1962 Beggs ..... H01J 9/04 427/77
3,201,639 A * 8/1965 Levi ..... H01J 1/28 313/346 R
(Continued)

OTHER PUBLICATIONS

Jinshu Wang et al., "Scandia doped tungsten matrix for impregnated cathode." Rare Metals, vol. 27, No. 1, pp. 9-12. (Year: 2008).*
(Continued)

*Primary Examiner* — Patricia L. Hailey
(74) *Attorney, Agent, or Firm* — US Naval Research Laboratory; Joslyn Barritt

(57) ABSTRACT

A thermionic dispenser cathode having a refractory metal matrix with scandium and barium compounds in contact with the metal matrix and methods for forming the same. The invention utilizes atomic layer deposition (ALD) to form a nanoscale, uniform, conformal distribution of a scandium compound on tungsten surfaces and further utilizes in situ high pressure consolidation/impregnation to enhance impregnation of a BaO—CaO—$Al_2O_3$ based emissive mixture into the scandate-coated tungsten matrix or to sinter a tungsten/scandate/barium composite structure. The result is a tungsten-scandate thermionic cathode having improved emission.

14 Claims, 3 Drawing Sheets

(51) Int. Cl.
*B22F 1/02* (2006.01)
*H01J 1/146* (2006.01)
*H01J 1/144* (2006.01)

(58) Field of Classification Search
USPC ..... 502/101; 427/126.3, 203, 205, 226, 327; 419/20, 31, 64
See application file for complete search history.

(56) References Cited

U.S. PATENT DOCUMENTS 3,358,178 A 12/1967 Figner et al.
3,719,856 A * 3/1973 Koppius ..... H01J 1/14 313/346 DC
4,007,393 A * 2/1977 Van Stratum ..... H01J 1/14 313/346 R
4,518,890 A * 5/1985 Taguchi ..... H01J 1/28 252/520.21
4,625,142 A * 11/1986 van Esdonk ..... H01J 9/04 313/346 DC
4,864,187 A * 9/1989 Sano ..... H01J 1/142 313/346 R
5,041,757 A * 8/1991 Longo ..... H01J 1/28 204/192.15
5,418,070 A * 5/1995 Green ..... H01J 1/28 313/364
2017/0073276 A1* 3/2017 Feigelson ..... C04B 35/443
2017/0358419 A1* 12/2017 Luhmann, Jr. ..... H01J 9/04

OTHER PUBLICATIONS

Jinshu Wang et al., "A study of Eu2O3, Sc2O3 co-doped tungsten matrix impregnated cathode." Journal of Physics and Chemistry of Solids 72, pp. 1128-1132. (Year: 2011).*
Jinshu Wang et al., "A Study of Scandia-Doped-Impregnated Cathode Fabricated by Spray Drying Method." IEEE Transactions on Electron Devices, vol. 62, No. 5, pp. 1635-1640. (Year: 2015).*
Yuntao Cui et al., "Characterization of scandia doped pressed cathode fabricated by spray drying method." Applied Surface Science 258, pp. 327-332. (Year: 2011).*
Jinshu Wang et al., "Effect of scandia doping method on the emission uniformity of scandate cathode with Sc2O3—W matrix." Materials Research Bulletin 48, pp. 3594-3600. (Year: 2013).*
J.H. Booske, "Plasma physics and related challenges of millimeter-wave-to-terahertz and high power microwave generation," Physics of Plasmas 15, 055502 (2008).
J. L. Cronin, "Modern Dispenser Cathodes," IEE Proc., vol. 128, Pt. I, No. I, pp. 19-33 (1981).
J. Wang et al., "Sc2O3—W matrix impregnated cathode with spherical grains," Journal of Physics and Chemistry of Solids 69 (2008) 2103-2108.
G. Gärtner et al., "Emission properties of top-layer scandate cathodes prepared by LAD," Applied Surface Science 111 (1997) 11-17.
J.H. Booske et al., "Vacuum Electronic High Power Terahertz Sources," IEEE Transactions on Terahertz Science and Technology, vol. 1, No. 1, Sep. 2011.
S. Yamamoto, et al., "Application of an Impregnated Cathode With W—Sc2O3 to a High Current Density Coated Electron Gun," Applied Surface Science 3/4 (1988) 1200-1207.
A. van Oostrom and L. Augustus, "Activation and Early Life of Pressed Barium Scandate Cathode," Applications of Surface Science 2 (1979) 173-186.
R.M. Jacobs et al., "Intrinsic defects and conduction characteristics of Sc2O3 in thermionic cathode systems," Phys. Rev. B 86, 054106 (2012).
J. Wang, W. Liu, L. Li, Y. Wang, Y. Wang, and M. Zhou, "A Study of Scandia-Doped Pressed Cathodes," IEEE Transactions on Electron Devices, vol. 56, No. 5, pp. 799 804 (2009).
S. Fukuda et al., "Performance of a high-power klystron using a BI cathode in the KEK electron linac," Applied Surface Science 146 1999 84-88.
J. Li et al., "Investigation and application of impregnated scandate cathodes," Applied Surface Science 215 (2003) 49-53.
J.W. Gibson, "Investigation of Scandate Cathodes: Emission, Fabrication, and Activation Processes," IEEE Transactions on Electron. Devices, vol. 16, No. 1, Jan. 1989.
C. Wan et al., "Tungslate formation in a model scandate thermionic cathode," J. Vacuum Science & Technology B 31(1), 011210 (2013).
J. Hasker et al., "Scandium Supply After Ion Bombardment of Scandate Cathodes," IEEE Trans. on Electron. Dev. vol. 37, No. 12, Dec. 1990, 2589-2594.
J. Hasker et al., "Properties and Manufacture of Top-Layer Scandate Cathodes," Appl. Sur. Sci. 26 (1986) 173-195.
S. Yamamoto et al., "Work Function Measurement of (W Sc2W3O12)-Coated Impregnated Cathode by Retarding Potential Method Utilizing Titaniated W(100) Field Emitter," Japanese Journal of Applied Physics, vol. 28, No. 5, May 1989, pp. L865-L867.
A. Shih et al., "Interaction of Sc and O on W," Applied Surface Science, 191 (2002) 44-51.
J. Wang et al., "Preparation and emission property of scandia pressed cathode," Journal of Rare Earths, vol. 28, Spec. Issue, Dec. 2010, p. 460.
S. Yamamoto, "Fundamental physics of vacuum electron sources," Rep. Prog. Phys. 6 (2006) 181-232.
Y. Wang et al., "Emission mechanism of high current density scandia-doped dispenser cathodes," J. Vacuum Sci. and Tech. B 29 04E106 (2011).
J. Wang et al., "A study of Eu2O3, Sc2O3 co-doped tungsten matrix impregnated cathode," Journal of Physics and Chemistry of Solids 72 (2011).
S. Yamamoto et al., "Electron Emission Properties and Surface Atom Behavior of Impregnated Cathodes with Rare Earth Oxide Mixed Matrix Base Metals," Applications of Surface Science 20 (1984) 69-83.

* cited by examiner

Clean W particles (temperature, $H_2$)

Form $Sc_2O_3$ coating on W particles via ALD

Prepare separate green compacts of $W/Sc_2O_3$ core/shells and emissive mix

Apply pressure at room temperature to fracture $Sc_2O_3$ and connect W particles Apply pressure and temperature to force ternary oxide into pores (in situ HP impregnation)

THERMIONIC TUNGSTEN/SCANDATE CATHODES AND METHODS OF MAKING THE SAME

CROSS-REFERENCE

This Application is a non-provisional of and claims the benefit of priority under 35 U.S.C. § 119 based on United States Provisional Patent Application No. 62/145,827 filed on Apr. 10, 2015. The Provisional Application and all references cited herein are hereby incorporated by reference into the present disclosure in their entirety.

TECHNICAL FIELD

This invention is related to a thermionic dispenser cathode having a refractory metal matrix with scandium and barium compounds in contact with the metal matrix and methods for forming the same.

BACKGROUND

Thermionic cathodes are used in critical civilian and military components including radar, communications, materials processing, electronic warfare, and high-energy physics research technologies. See J. H. Booske, "Plasma physics and related challenges of millimeter-wave-to-terahertz and high power microwave generation," *Physics Of Plasmas* 15, 055502 (2008) ("Booske 2008").

In traditional cathodes, increased electron emission is generally achieved by increasing the operating temperature, but results in degradation of the cathode by the depletion of surface barium (Ba) through evaporation, effectively decreasing the lifetime of the cathodes.

Scandate-based cathodes share the same backbone as common thermionic emitters such as the dispenser B-type cathode composed of pressed and sintered tungsten powder impregnated with a precise compositional mixtures of an emissive mix comprising BaO, CaO, and $Al_2O_3$. See J. L. Cronin, "Modern Dispenser Cathodes," *IEE PROC.*, Vol. 128, Pt. I, No. 1. pp. 19-33 (1981).

Academic and industrial research have established that scandate-based cathodes have the potential to be the next generation electron emitter cathodes based on the demonstration of substantially improved emission properties over other thermionic electron emitters. The best scandate-based cathodes reach a current density of 52 A/cm2 at 850° C., see Wang 2008, supra, though some scandate-based cathodes systems have displayed current densities of ~400 A/cm2 at temperatures of 965° C. (an 800% improvement in emission over traditional cathodes). See G. Gärtner et al., "Emission properties of top-layer scandate cathodes prepared by LAD," *Applied Surface Science* 111 (1997) 11-17. Such improvements can lead to longer lifetimes and vastly improved device characteristics for devices which require a large supply of emitted electrons and high power densities, such as THz-regime vacuum electronic devices, high resolution display tubes, and pick-up tubes. See Booske 2008, supra; J. H. Booske et al., "Vacuum Electronic High Power Terahertz Sources," *IEEE Transactions On Terahertz Science And Technology*, Vol. 1, No. 1, September 2011 ("Booske 2011"); and S. Yamamoto, et al., "Application of an Impregnated Cathode With W-$Sc_2O_3$ to a High Current Density Coated Electron Gun," *Applied Surface Science* 3/4 (1988) 1200- 1207 ("Yamamoto 1988").

"Traditional" scandate cathodes simply augment the compositional mixture of oxides to include small amounts of $Sc_2O_3$. See A. van Oostrom and L. Augustus, "Activation and Early Life of Pressed Barium Scandate Cathode." *Applications of Surface Science* 2 (1979) 173-186. The cathodes are produced by sintering the powder mixtures or impregnating a partially sintered tungsten metal matrix with the emissive mix. Though these early studies revealed the enhanced emission of scandate-based cathodes by demonstrating current densities of ~10 A/cm$^2$ at 950° C., such preparation techniques have been shown to produce cathodes with non-uniformity and instability in electron emission, see R. M. Jacobs et al., "Intrinsic defects and conduction characteristics of $Sc_2O_3$ in thermionic cathode systems," *Phys. Rev. B* 86, 054106 (2012); van Oostrom, supra; and J. Wang, W. Liu, L. Li, Y. Wang, Y. Wang, and M. Zhou, "A Study of Scandia-Doped Pressed Cathodes," IEEE Transactions on Electron Devices, Vol. 56, No. 5, pp. 799-804 (2009) ("Wang 2009"), and do not provide enough processing control to allow consistent reproducibility in cathode behavior. See Gärtner, supra.

High electron emission scandate-based cathodes systems were discovered approximately 50 years ago. See U.S. Pat. No. 3,358,178 Figner et al., "Metal-Porous Body Having Pores Filled with Barium Scandate"; and van Oostrom, supra. However, they have failed to make the transition from laboratory demonstration to industrial production in all but a few limited cases, see S. Fukuda et al., "Performance of a high-power klystron using a BI cathode in the KEK electron linac," *Applied Surface Science* 146 1999 84-88; and J. Li et al., "Investigation and application of impregnated scandate cathodes," *Applied Surface Science* 215 (2003) 49-53, as a result of observed non-uniformity and instability in electron emission, see J. W. Gibson, "Investigation of Scandate Cathodes: Emission, Fabrication, and. Activation Processes." *IEEE Transactions on Electron. Devices*, Vol. 16, No. 1, January 1989. More recent studies have highlighted the obvious need for control over the microstructural uniformity of the scandate nanostructure and the location of scandate relative to the tungsten metal matrix. See Wang 2009, supra; see also J. Wang et al., "$Sc2O_3$-W matrix impregnated cathode with spherical grains," *Journal of Physics and Chemistry of Solids* 69 (2008) 2103-2108 ("Wang 2008").

The most recent attempts to evenly distribute scandate have endeavored to co-dope tungsten with scandium, resulting in various distributions of nano-scale scandate particles on sub-micron tungsten powders. The best emission arises from cathodes comprised of sub-micron tungsten with the "most even" distribution of scandate nanopowders. See Wang 2008, supra. While these appear to be the "best" cathodes, the publications often state that dozens of cathodes were tested before optimal emission was achieved, suggesting poor control over the process of distributing scandate. Better control over the scandate coating and overall microstructural design of the cathode (such as tungsten powder size and scandate thickness) might lead to even greater improvements in emission. Furthermore, thin film studies on model cathode systems have identified the need to have the scandate as a separate nanometer thick layer in between the emissive mix and the tungsten, see C. Wan et al., "Tungstate formation in a model scandate thermionic cathode," *J. Vacuum Science & Technology B* 31(1), 011210 (2013), for enhanced electron emission. Therefore, it appears that the "best" cathodes should actually have conformal and uniform nanometer thick scandate directly on tungsten powders (sub-micron or nano).

Various attempts have been made to mitigate the issues describe above, including use of different powder mixtures, see J. Hasker et al., "Scandium Supply After Ion Bombardment of Scandate Cathodes," IEEE Trans. on Electron. Dev. Vol. 37, No. 12, December 1990, 2589-2594 ("Hasker 1990"), and coating the top of the cathode with tungsten (W) and various scandates. See Yamamoto 1988, supra; see also J. Hasker et al., "Properties and Manufacture of Top-Layer Scandate Cathodes," Appl. Sur. Sci. 26 (1986) 173-195 ("Hasker 1986"); and S. Yamamoto et al., "Work Function Measurement of (W-$Sc_2W_3O_{12}$)-Coated Impregnated Cathode by Retarding Potential Method Utilizing Titaniated W(100) Field Emitter," *Japanese Journal of Applied Physics*, Vol. 28, No, 5, May 1989, pp. L865-L867 ("Yamamoto 1989").

Recent studies suggest that the emission uniformity of scandate cathodes primarily depend on the distribution of the scandate, with a more uniform distribution leading to more uniform emission. See A. Shih et al., "Interaction of Sc and O on W," *Applied Surface Science,* 191 (2002) 44-51; and J. Wang et al., "Preparation and emission property of scandia pressed cathode," *Journal of Rare Earths*, Vol. 28, Spec. Issue, December 2010, p. 460 ("Wang 2010"). Therefore, state-of-the-art techniques employ liquid-liquid doping techniques in an effort to evenly distribute scandium by precipitating scandium-"doped" tungsten or tungsten oxide (then reducing the tungsten oxide with hydrogen). See Wang 2008, supra, and Wang 2010, supra. The scandium/tungsten powder can then be sintered and impregnated with the traditional oxide mixture.

However, electron microscopy reveals that nanoparticles of scandium oxide actually co-precipitate on the surface of the tungsten powder see Wang 2008, supra, rather than "dope" the tungsten. More importantly, microscopy reveals that, while nanoparticles cling to many of the tungsten particles, there are tungsten particles void of scandium oxide.

It has been theorized that a Ba—Sc—O monolayer formed on the tungsten substrate is responsible for the high emission density, see S. Yamamoto, "Fundamental physics of vacuum electron sources," *Rep. Prog. Phys.* 6 (2006) 181-232 ("Yamamoto 2006") and Y. Wang et al., "Emission mechanism of high current density scandia-doped dispenser cathodes," *J. Vacuum Sci. and Tech.* B 29 04E106 (2011) ("Wang 2011"), suggesting that the order or layering of the Ba (i.e. emissive mix) is not critical.

However, more recent systematic studies on model thin-film scandate cathodes reveal that the best thermionic electron emission is observed from areas initially composed of 200 nm of BaO deposited on 200 nm of $Sc_2O_3$ deposited on tungsten. See Wan et al., supra. A reversed thin-film cathode structure, where $Sc_2O_3$ was deposited onto BaO was determined be a poor emitter and heating of that surface produced residual surface coverage of bulk crystals. For the BaO on $Sc_2O_3$ on W, at the end of the cathode life (since they are thin film cathodes there is no replenishment of emitting material) the deposition/emission area was completely devoid of thin film BaO, $Sc_2O_3$, of observable bulk oxide, or tungstate material. It is suggested that the scandate acts as a barrier between the BaO and tungsten that prohibits the formation of any barium tungstate, which reduces the emissive properties. Importantly, the key similarity between the co-precipitated "doping" process and the thin-film studies is the nanostructure of the scandate material which resides in between the BaO (or oxide mixture) and the tungsten metal frame.

Interestingly, the exact role of the scandate in the enhanced electron emission process is not well understood. A few experimental attempts to replace scandium with another similar element, such as europium and other rare earths, have resulted in reduced emission. See J. Wang et al., "A study of $Eu_2O_3$, $Sc_2O_3$ co-doped tungsten matrix impregnated cathode," *Journal of Physics and Chemistry of Solids* 72 (2011) 1128-1132; and S. Yamamoto et al., "Electron Emission Properties and Surface Atom Behavior of Impregnated Cathodes with Rare Earth Oxide Mixed Matrix Base Metals," *Applications of Surface Science* 20 (1984) 69-83 ("Yamamoto 1984"). Since conventional theory expects that elements from the same group (i.e., column in the periodic table) should behave similarly and that the Lanthanide series also exhibit similar behaviors, the finding that Eu does not mimic Sc in these cathodes systems suggests that identifying an alternative material will be difficult.

Though a theoretical consensus has yet to be determined, careful review of experimental work identifies two critical elements for optimal and consistent emission, the uniformity of the scandate material that acts as a barrier between the emissive mix and the tungsten surface and its nano-sized scale. Furthermore, modifications to the scandate thickness and the tungsten particle size may even improve the scandate cathode emission properties.

SUMMARY

This summary is intended to introduce, in simplified form, a selection of concepts that are further described in the Detailed Description. This summary is not intended to identify key or essential features of the claimed subject matter, nor is it intended to be used as an aid in determining the scope of the claimed subject matter. Instead, it is merely presented as a brief overview of the subject matter described and claimed herein.

The present invention provides a dispenser cathode comprising a refractory metal matrix with scandium and barium compounds in contact with metal matrix and methods for making the same.

The present invention provides a novel two-step fabrication method that creates a uniform and nano-scale scandate layer on sub-micron tungsten powders and subsequently consolidates the powder while retaining the architectured microstructure in the bulk cathode.

The present invention utilizes an in situ high pressure consolidation/impregnation technique that enhances impregnation of scandate into tungsten powder.

Using particle atomic layer deposition (ALD) of scandium oxide in the first step, the method of the present invention will bring unmatched conformal control and unprecedented uniformity of the scandate material in addition to allowing the thickness to be tailored from angstroms to 100s of nanometers.

Using high pressure sintering at 0.1-5 GPa and moderate temperatures in the second step, the method of the present invention will allow complete (i.e., to full density) consolidation of the cathode while retaining the nanostructure of the ALD-processed material.

These processes have not been employed previously individually or in tandem and such a combination will revolutionize scandate cathode production by allowing high emission cathodes to be produced on an industrial scale with unprecedented microstructural control and reproducibility.

In some embodiments, a method for making a dispenser cathode comprising a refractory metal matrix with scandium and barium compounds in contact with metal matrix in accordance with the present invention includes the steps of coating a metal surface with scandium and barium compounds.

In some embodiments, a method for making a dispenser cathode comprising a refractory metal matrix with scandium and barium compounds in contact with metal matrix in accordance with the present invention includes the steps of coating a metal surface with scandium and barium compounds as a conformal coating on the metal surface.

In some embodiments, a method for making a dispenser cathode comprising a refractory metal matrix with scandium and barium compounds in contact with metal matrix in accordance with the present invention includes the steps of coating a metal surface with scandium and barium compounds as a conformal coating on a metal surface with a coating thickness at nanometer scale.

This invention can be used to form a dispenser cathode from refractory metal powder coated with nanometer thick scandate film.

This invention can also be used to form a dispenser cathode from refractory porous metal coated with nanometer thick scandate film and barium oxide film.

These and other aspects of this invention can be accomplished by new process of making a dispenser cathode described in detail below.

DETAILED DESCRIPTION

Figure 1:
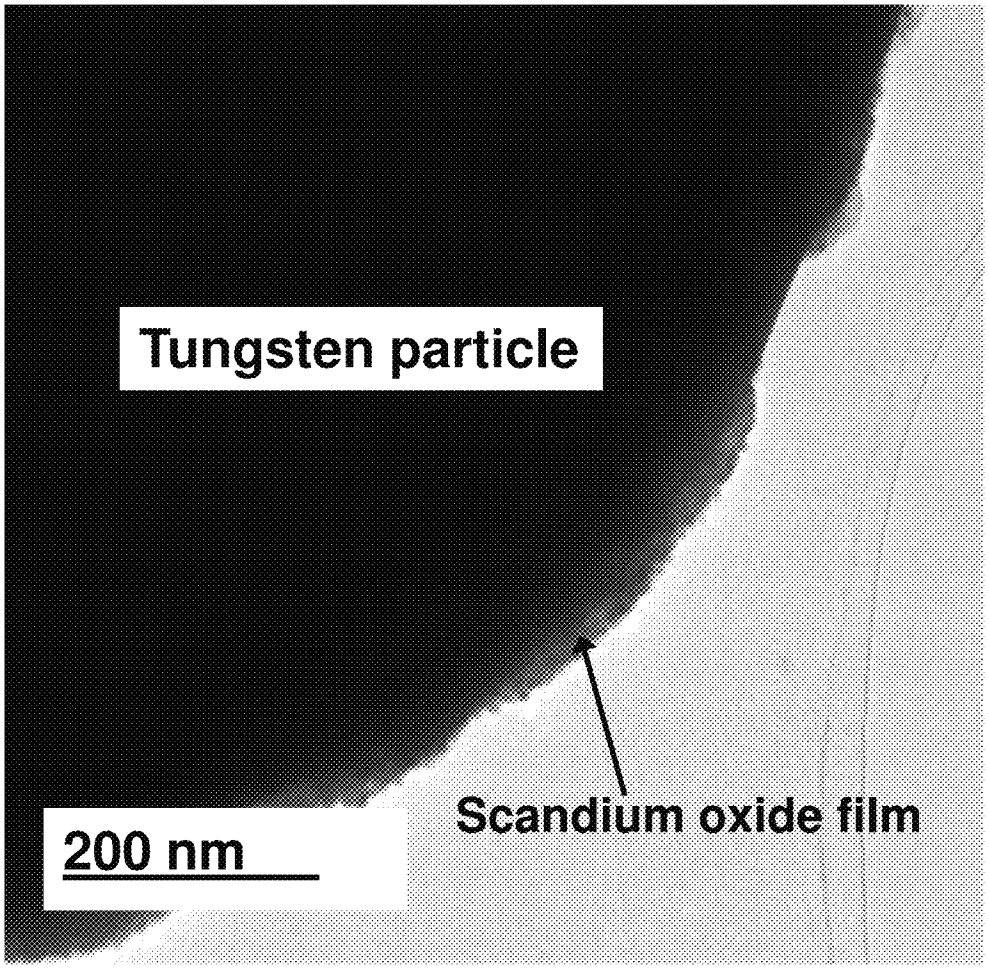
FIG. 1 is a transmission electron microscopy (TEM) image of a tungsten particle coated with a 10-nm thick film of scandium oxide.

The aspects and features of the present invention summarized above can be embodied in various forms. The following description shows, by way of illustration, combinations and configurations in which the aspects and features can be put into practice. It is understood that the described aspects, features, and/or embodiments are merely examples, and that one skilled in the art may utilize other aspects, features, and/or embodiments or make structural and functional modifications without departing from the scope of the present disclosure.

The present invention provides a dispenser cathode comprising a refractory metal matrix with scandium and barium compounds in contact with metal matrix and methods for making the same.

The method of present invention provides a universal approach for making bulk nanostructures of ceramics, semiconductors and metal using traditional sintering based techniques, including but not limited to Spark Plasma Sintering, microwave sintering, and high pressure sintering that have not previously demonstrated successes in producing fully dense bulk materials with grain sizes <50 nm.

As described in more detail below, the present invention provides a novel two-step fabrication method that creates a uniform and nano-scale scandate film on sub-micron tungsten powders and subsequently consolidates the powder while retaining the architectured microstructure in the bulk cathode. This two-step method utilizes an in situ high pressure consolidation/impregnation technique that enhances impregnation of scandate into tungsten powder.

By using particle atomic layer deposition (ALD) of scandium oxide in the first step, the method of the present invention will bring unmatched conformal control and unprecedented uniformity of the scandate material in addition to allowing the thickness to be tailored from angstroms to 100s of nanometers.

By using high pressure sintering at 0.1-5 GPa and moderate temperatures in the second step, the method of the present invention will allow complete (i.e., to full density) consolidation of the cathode while retaining the nanostructure of the ALD-processed material.

These processes have not been employed previously individually or in tandem and such a combination will revolutionize scandate cathode production by allowing high emission cathodes to be produced on an industrial scale with unprecedented microstructural control and reproducibility.

In some embodiments, a method for making a dispenser cathode comprising a refractory metal matrix with scandium and barium compounds in contact with metal matrix in accordance with the present invention includes the steps of coating a metal surface with scandium and barium compounds.

In some embodiments, a method for making a dispenser cathode comprising a refractory metal matrix with scandium and barium compounds in contact with metal matrix in accordance with the present invention includes the steps of coating a metal surface with scandium and barium compounds as a conformal coating on the metal surface.

In some embodiments, a method for making a dispenser cathode comprising a refractory metal matrix with scandium and barium compounds in contact with metal matrix in accordance with the present invention includes the steps of coating a metal surface with scandium and barium compounds as a conformal coating on a metal surface with a coating thickness at nanometer scale.

These and other aspects of processes for making a thermionic dispenser cathode in accordance with the present invention can be achieved by means of any one or more of the embodiments described below.

First Embodiment

In this first embodiment, a refractory metal and/or metal alloy powder is provided and treated to provide a scandium-coated and barium-impregnated cathode.

In the description below, the refractory metal and/or metal alloy powder used as a starting material is tungsten (W) powder, typically of micron or sub-micron size, but other refractory metal and/or metal alloy powders can be used as appropriate.

The first step in this embodiment is cleaning tungsten oxides from the surface of the W powder by reducing the W powder in a hydrogen atmosphere at an elevated temperature. This step is preferably conducted in a furnace, which will permit the transfer of the reduced (i.e., cleaned) W powder to a deposition chamber without exposing the reduced W powder to the atmospheric air.

Figure 2:
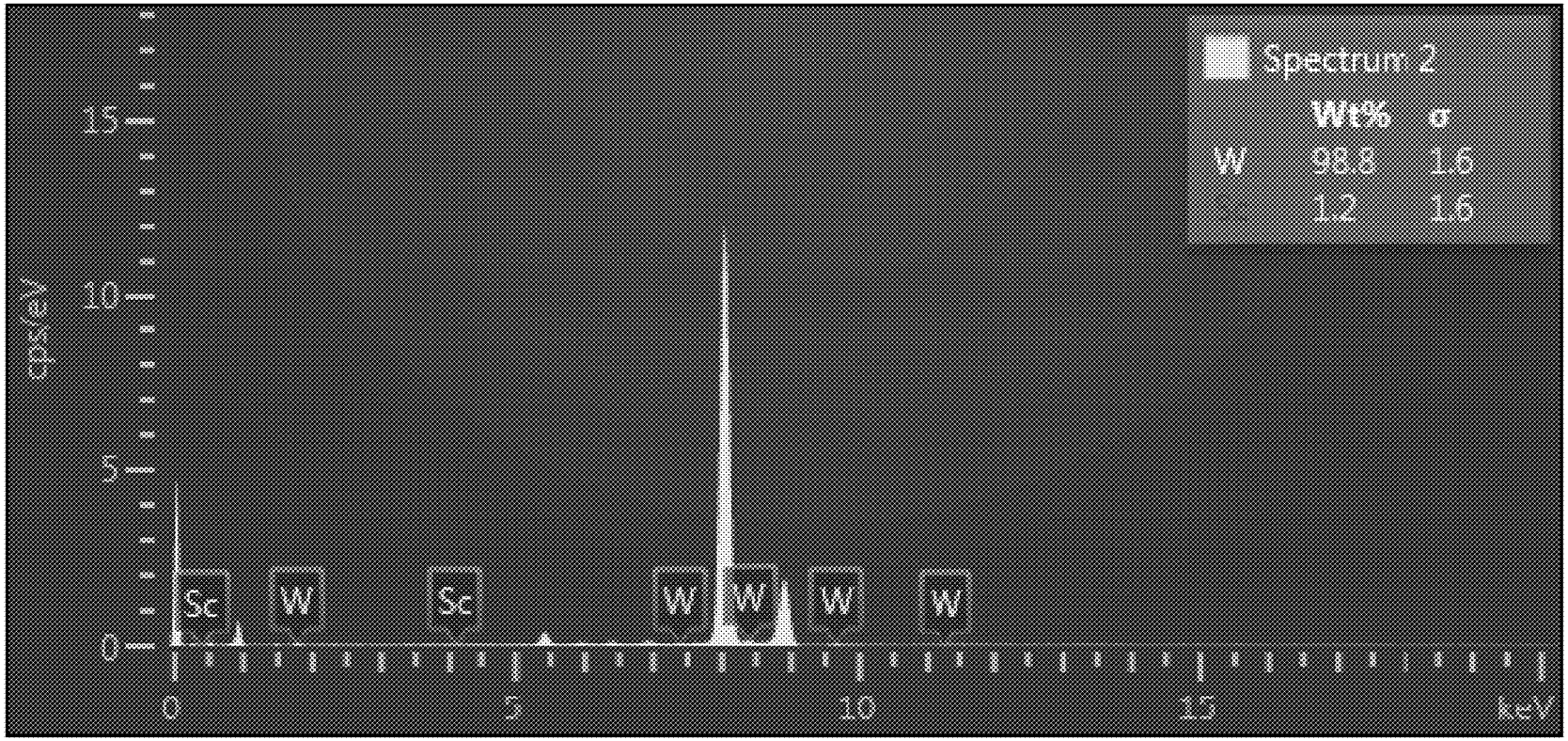
FIG. 2 is a plot illustrating the results of an energy-dispersive X-ray spectroscopy (EDX) characterization conforming scandium on tungsten.

In the second step of this embodiment, the W powder is transferred to a deposition chamber and all particles of the cleaned W powder are coated with a conformal nanometer-thick film of a scandium compound. The TEM image in FIG. 1 illustrates an exemplary coated tungsten particle in accordance with this aspect of the present invention, where the tungsten particle is coated with a 10-nm thick film of a scandium compound to form a scandium compound-coated W powder (W/Sc). The energy-dispersive X-ray spectroscopy shown in FIG. 2 collected from the region shown in FIG. 1 illustrates that the transition metal compounds comprising the coated powder are scandium and tungsten. The film can be continuous or discontinuous. This step requires precise control of the nanoscale thickness or amount of the deposited scandium compound as well as uniform distribution of the scandium compound on the surface of all particles of the powder. Although any film deposition process or technique including CVD, sputtering, electro deposition, etc. can be used for deposition of the scandium compound on the W powder, particle atomic layer deposition (pALD) is preferred because it provides superior conformal control and unprecedented uniformity of the scandate material in addition to allowing the thickness to be tailored from angstroms to 100s of nanometers. Scandium oxide is the preferred scandium compound, but other suitable scandium compounds may be used as appropriate.

In a third step of this embodiment, the scandium compound-coated W powder (W/Sc) is contacted with an emissive mix usually comprising, but not limited to BaO, CaO, and $Al_2O_3$. The emissive mix is preferably Ba—CaO—$Al_2O_3$ but other suitable compounds including BaO, CaO, and/or $Al_2O_3$ may be used as appropriate.

In a fourth step in this embodiment, pressure is then applied at room temperature to create a W/Sc compact from the W/Sc powder, the W/Sc compact being in contact with the emissive mixture. The pressure should be high enough to break the thin film of Sc compound so as to make electrical contact between the W particles but should not exceed a level that would cause the W/Sc compact to become so densified that it doesn't have open porosity. It is preferable that this fourth step be conducted without exposing the W/Sc powder to air.

In a fifth step in this embodiment, the W/Sc compact in contact with the emissive mixture is heated to a temperature exceeding the melting point of the emissive mixture so as to cause the molten emissive mixture to impregnate the porous W/Sc compound compact. Impregnation under pressure creates an additional force for more efficient and complete impregnation and allows to use W powder with particle size less than 1 micron.

In exemplary cases, the pressure can be between about 0.1-5 GPa and the temperature can be between 1500° C. and 2100° C., but other appropriate pressures and temperatures can also be used.

Second Embodiment

In a second exemplary embodiment, a porous preformed compact is formed from the refractory metal and/or metal alloy powder and is placed inside an atomic layer deposition reactor.

As in the first embodiment, in the description below, the refractory metal and/or metal alloy powder used as a starting material is tungsten (W) powder, typically of micron or sub-micron size, but other refractory metal and/or metal alloy powders can be used as appropriate.

In this second embodiment, the first step is the same as in the first embodiment, i.e., cleaning tungsten oxides from the surface of the W powder by reducing the W powder in a hydrogen atmosphere at an elevated temperature. This step is preferably conducted in a furnace, which will permit the transfer of the reduced (i.e., cleaned) W powder to the deposition chamber without exposing the reduced W powder to the atmospheric air.

The second step is making a porous tungsten compact with connected porosity (W compact) from the W powder. The compact can be made by any suitable technique but is preferably made without exposing the cleaned W powder to air.

In a third step, the W compact is transferred to a deposition chamber and all available surfaces of the porous W compact are coated with a conformal nanometer-thick film of a scandium compound to produce a W/Sc compact. The film can be continuous or discontinuous. This step requires precise control of the nanoscale thickness or amount of the deposited scandium compound as well as uniform distribution of the scandium compound on all available surfaces in pores inside of W compact. Although any film deposition process or technique including CVD, sputtering, electro deposition, etc. can be used for deposition of the scandium compound on the W compact, particle atomic layer deposition (pALD) is preferred because it provides superior conformal control and unprecedented uniformity of the scandate material in addition to allowing the thickness to be tailored from angstroms to 100s of nanometers. Scandium oxide is the preferred scandium compound, but other suitable scandium compounds may be used as appropriate.

In a fourth step, the W/Sc compact is contacted with an emissive mixture usually comprising, but not limited to BaO, CaO, and $Al_2O_3$. The emissive mix is preferably Ba—CaO—$Al_2O_3$ but other suitable compounds including BaO, CaO, and/or $Al_2O_3$ may be used as appropriate.

In a fifth step in this embodiment, pressure is applied at room temperature, with the pressure not exceeding a level at which the W/Sc compact becomes so densified that it doesn't have open or connected porosity. It is preferable that this fifth step be conducted without exposing the W/Sc compact to air.

In a sixth step, the W/Sc compact in contact with emissive mix is heated to a temperature exceeding the melting point of the emissive mix so as to cause the molten emissive mix to impregnate the porous W/Sc compact. Impregnation under pressure creates an additional force for more efficient and complete impregnation and allows the use of a W compact having pore sizes of less than 1 micron.

The pressure P can be between about 0.1-5 GPa and the temperature can be between 1500° C. and 2100° C. , but other appropriate pressures and temperatures can also be used.

Third Embodiment

In a third exemplary embodiment, there is provided a porous refractory metal and/or metal alloy, with the porous refractory metal and/or metal alloy being coated with a scandium compound and being placed in contact with an emissive mixture.

In the description below, the sample porous refractory metal and/or metal alloy with connected porosity is a porous tungsten (W) metal sample but other suitable metals and/or metal alloys may be used as appropriate.

The first step in this embodiment is cleaning tungsten oxides from the surface of the porous W metal sample by reducing the sample in a hydrogen atmosphere at an elevated temperature to produce a reduced (i.e., cleaned) porous W sample. This step is preferably conducted in a furnace, which will permit the transfer of the reduced porous W sample to a deposition chamber for the next step without exposing the porous W sample to the atmospheric air.

In the second step, all surfaces of the porous W sample are coated with a conformal nanometer-thick film of a scandium compound. The film can be continuous or discontinuous. This step requires precise control of nanoscale thickness or amount of the deposited scandium compound as well as uniform distribution of a scandium compound on all available surfaces in pores inside of the porous W sample to produce a scandium compound-coated porous W sample (porous W/Sc sample). Although any film deposition process or technique including CVD, sputtering, electro deposition, etc. can be used for deposition of the scandium compound on the W sample, particle atomic layer deposition (pALD) is preferred because it provides superior conformal control and unprecedented uniformity of the scandate material in addition to allowing the thickness to be tailored from angstroms to 100s of nanometers. Scandium oxide is the preferred scandium compound, but other suitable scandium compounds may be used as appropriate.

In a third step in this embodiment, the scandium compound-coated porous W sample (porous W/Sc sample) is contacted with an emissive mixture usually comprising, but not limited to, BaO, CaO, and $Al_2O_3$. The emissive mix is preferably Ba—CaO—$Al_2O_3$ but other suitable compounds including BaO, CaO, and/or $Al_2O_3$ may be used as appropriate.

In a fourth step, pressure is then applied to the porous W/Sc sample contacted with the emissive mixture at room temperature. The pressure should be high enough to break the thin film of Sc compound so as to make electrical contact between the W particles but should not exceed a level that would cause the porous W/Sc to become so densified that it doesn't have open or connected porosity. It is preferred that this fourth step be conducted without exposing the porous W/Sc sample to air.

In a fifth step, the porous W/Sc sample in contact with the emissive mixture is heated to a temperature that exceeds the melting point of the emissive mix so as to cause the molten emissive mix to impregnate porous W/Sc sample. Impregnation under pressure creates an additional force for more efficient and complete impregnation and allows to use porous W with pore sizes of less than 1 micron.

The pressure P can be between about 0.1-5 GPa and the temperature can be between 1500° C. and 2100° C., but other appropriate pressures and temperatures can also be used.

Fourth Embodiment

In a fourth exemplary embodiment, a refractory metal and/or metal alloy powder is coated with conformal nanometer-scale film of a scandium compound and a conformal layer of barium compound.

In the description below, the refractory metal and/or metal alloy powder used as a starting material is tungsten (W) powder, typically of micron or sub-micron size, but other refractory metal and/or metal alloy powders can be used as appropriate.

In a first step of this embodiment, the W powder is cleaned as described above with respect to the first embodiment.

In a second step of this embodiment, the cleaned W powder is transferred to a deposition chamber and all particles of the cleaned W powder are coated with a conformal nanometer-thick film of a scandium compound to form a scandium compound-coated W (W/Sc) powder. The film can be continuous or discontinuous. This step requires precise control of the nanoscale thickness or amount of the deposited scandium compound as well as uniform distribution of the scandium compound on the surface of all particles of the powder. Although any suitable film deposition process or technique including CVD, sputtering, electro deposition, etc. can be used for deposition of the scandium compound on the W powder, particle atomic layer deposition (pALD) is preferred because it provides superior conformal control and unprecedented uniformity of the scandate material in addition to allowing the thickness to be tailored from angstroms to 100s of nanometers. Scandium oxide is preferred scandium compound, but other suitable scandium compounds may be used as appropriate.

In a third step of this embodiment, the particles of the W/Sc powder are further coated with a conformal nanometer-thick film of a barium (Ba) compound to form a scandium- and barium-coated (W/Sc/Ba) W powder, where the Ba film on any given particle can be continuous or discontinuous. As with the scandium compound deposited in the previous step, this step requires precise control of the nanoscale thickness or amount of the deposited scandium compound as well as uniform distribution of the barium compound on the surface of all particles of the powder. As with the deposition of the scandium compound, although any suitable film deposition process or technique including CVD, sputtering, electro deposition, etc. can be used for deposition of the barium compound on the W/Sc powder, particle atomic layer deposition (pALD) is preferred particle atomic layer deposition (pALD) is preferred because it provides superior conformal control and unprecedented uniformity of the barium material in addition to allowing the thickness to be tailored from angstroms to 100s of nanometers. Barium oxide is the preferred barium compound, but other suitable barium compounds can be used as appropriate.

In a fourth step, pressure is applied to the W/Sc/Ba powder at room temperature and without exposing the W/Sc/Ba powder to the atmosphere to create a W/Sc/Ba compact from the W/Sc/Ba powder. The pressure should be high enough to break the Sc/Ba thin film on the particles so as to permit electrical contact between the W particles but should not exceed a level that would cause the W/Sc/Ba compact to become so densified that it doesn't have open porosity.

Finally, in a fifth step, the W/Sc/Ba compact is heated to a temperature high enough to sinter the W/Sc/Ba compact to a dense compact at the applied pressure, where the dense compact doesn't have a connected porosity or a porosity less than 15%.

The pressure P can be between about 0.1-5 GPa and the temperature can be between 800° C. and 2100° C., but other appropriate pressures and temperatures can also be used.

Fifth Embodiment

In a fifth embodiment, a porous preformed compact is formed from a refractory metal and/or metal alloy powder and is coated with conformal nanometer-scale film of a scandium compound and a conformal layer of barium compound.

In the description below, the refractory metal and/or metal alloy powder is tungsten (W) powder, typically of micro or sub-micron size, but other refractory metal and/or metal alloy powders can be used as appropriate.

In a first step of this embodiment, the W powder is cleaned as described above with respect to the first embodiment.

In a second step, a porous tungsten compact (W compact) having connected porosity is made from the cleaned W powder. The compact can be made by any suitable technique but is preferably made without exposing the cleaned W powder to air.

In a third step, the W compact is transferred to a deposition chamber and all available surfaces of the W compact are coated with a conformal nanometer-thick film of a scandium compound to produce a W/Sc compact. The film can be continuous or discontinuous. This step requires precise control of the nanoscale thickness or amount of the deposited scandium compound as well as uniform distribution of the scandium compound on all available surfaces in pores inside of W compact. Although any suitable film deposition process or technique including CVD, sputtering, electro deposition, etc. can be used for deposition of the scandium compound deposition on the W compact, particle atomic layer deposition (pALD) is preferred because it provides superior conformal control and unprecedented uniformity of the scandate material in addition to allowing the thickness to be tailored from angstroms to 100s of nanometers. Scandium oxide is the preferred scandium compound, but other suitable scandium compounds can be used as appropriate.

In a fourth step of this embodiment, the W/Sc compact is further coated with a conformal nanometer-thick film of a barium (Ba) compound to form a scandium- and barium-coated W compact (W/Sc/B compact), where the Ba film on any given particle can be continuous or discontinuous. As with the scandium compound deposited in the previous step, this step requires precise control of the nanoscale thickness or amount of the deposited scandium compound as well as uniform distribution of the barium compound on the surface of all particles of the powder. Although any suitable film deposition process or technique including CVD, sputtering, electro deposition, etc. can be used for deposition of the barium compound on the W/Sc compact, particle atomic layer deposition (pALD) is preferred because it provides superior conformal control and unprecedented uniformity of the barium material in addition to allowing the thickness to be tailored from angstroms to 100s of nanometers. Barium oxide is the preferred barium compound, but other suitable barium compounds can be used as appropriate.

In a fifth step, pressure is applied to the W/Sc/B compact at room temperature and without exposing the W/Sc/B compact to the atmosphere.

Finally, in a sixth step, still without exposing the W/Sc/Ba compact to air, the W/Sc/Ba compact is heated to a temperature high enough to sinter the W/Sc/Ba compact to a dense compact at the applied pressure, where the dense compact doesn't have a connected porosity or a porosity less than 15%.

The pressure P can be between about 0.1-5 GPa and the temperature can be between 800° C. and 2100° C., but other appropriate pressures and temperatures can also be used.

Sixth Embodiment

The sixth embodiment is similar to the fifth embodiment, but the starting material is a sample of porous refractory metal and/or metal alloy with connected porosity, with the metal sample being coated with conformal nanometer-scale film of a scandium compound and a conformal layer of barium compound.

As with the other embodiments described herein, in the description below, the porous refractory metal and/or metal alloy with connected porosity used as a starting material in this embodiment is a porous tungsten (W) metal but other suitable metals and/or metal alloys may be used as appropriate.

The first step in this embodiment is cleaning tungsten oxides from the surface of the porous W sample by reducing the sample in a hydrogen atmosphere at an elevated temperature to produce a reduced (i.e., cleaned) porous W sample. This step is preferably conducted in a furnace, which will permit the transfer of the reduced porous W sample to a deposition chamber for the next step without exposing the porous W sample to the atmospheric air.

In the second step, all surfaces of the porous W sample are coated with a conformal nanometer-thick film of a scandium compound. The film can be continuous or discontinuous. This step requires precise control of nanoscale thickness or amount of the deposited scandium compound as well as uniform distribution of a scandium compound on all available surfaces in pores inside of the porous W sample to produce a scandium compound-coated porous W sample (porous W/Sc sample). Although any suitable film deposition process or technique including CVD, sputtering, electro deposition, etc. can be used for deposition of the scandium compound on the porous W sample, particle atomic layer deposition (pALD) is preferred because it provides superior conformal control and unprecedented uniformity of the scandate material in addition to allowing the thickness to be tailored from angstroms to 100s of nanometers. Scandium oxide is preferred scandium compound but other suitable scandium compounds may be used as appropriate.

In a third step of this embodiment, the scandium compound-coated porous W sample (porous W/Sc sample) is further coated with a conformal nanometer-thick film of a barium (B a) compound to form a scandium- and barium-coated porous W/Sc (W/Sc/Ba) sample, where the Ba film on the sample can be continuous or discontinuous. As with the scandium compound deposited in the previous step, this step requires precise control of the nanoscale thickness or amount of the deposited scandium compound as well as uniform distribution of the barium compound on all surfaces of the porous W/Sc sample. Although any suitable film deposition process or technique including CVD, sputtering, electro deposition, etc. can be used for deposition of the barium compound on the porous W sample, particle atomic layer deposition (pALD) is preferred because it provides superior conformal control and unprecedented uniformity of the barium material in addition to allowing the thickness to be tailored from angstroms to 100s of nanometers. Barium oxide is the preferred barium compound, but other suitable barium compounds may be used as appropriate.

In a fourth step, pressure is applied to the W/Sc/Ba sample at room temperature and without exposing the W/Sc/Ba sample to the atmosphere.

Finally, in a fifth step, the W/Sc/Ba sample is heated to a temperature high enough to sinter the W/Sc/Ba sample at the applied pressure, where the sintered W/Sc/Ba sample doesn't have a connected porosity or a porosity less than 15%.

The pressure P can be between about 0.1-5 GPa and the temperature can be between 800° C. and 2100° C., but other appropriate pressures and temperatures can also be used.

EXAMPLE

FIG. 3 is a flow diagram illustrating a process flow used in this Example and shows the final structure of the scandate cathode made in this example.

Figure 3A:
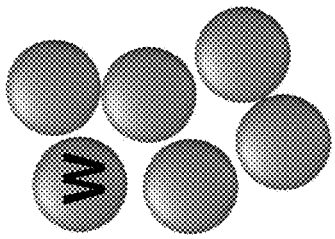
FIGS. 3A-3E are flow diagrams illustrating aspects of a method for making a thermionic tungsten/scandate cathode in accordance with the present invention.
Figure 3B:
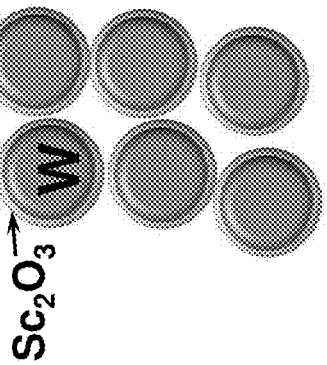
Figure 3C:
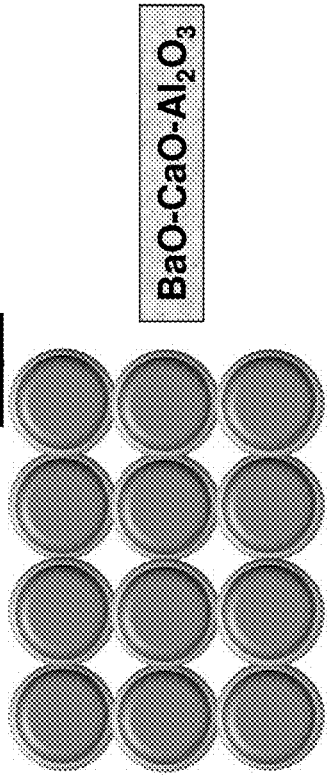
Figure 3D:
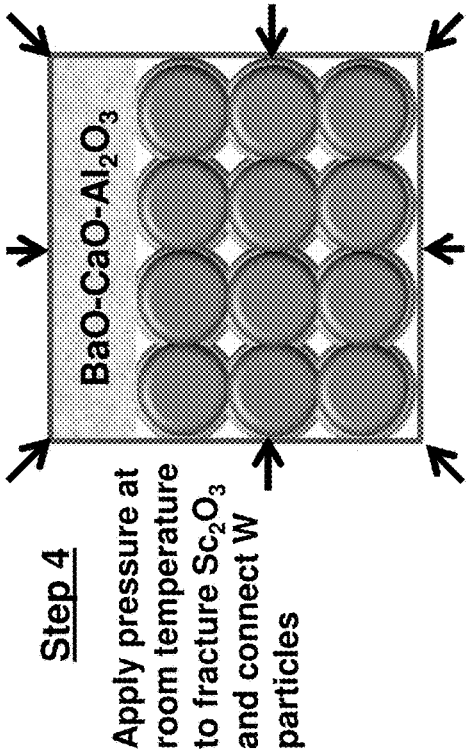
Figure 3E:
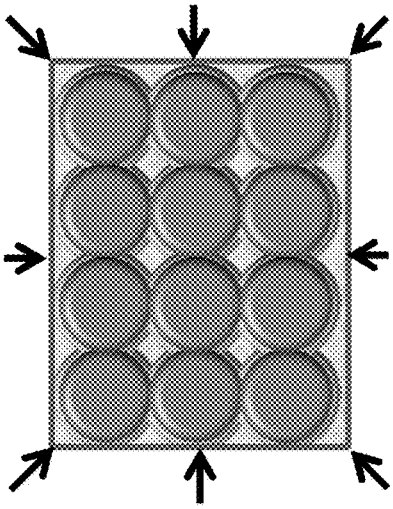

Tungsten powder 4-8 micron was placed in a tube furnace and was heated at about 900° C. for 1 hour in a hydrogen atmosphere to clean the particles and reduce tungsten oxide on their surface (FIG. 3A). After the treatment, the cleaned tungsten powder was transferred to a rotary atomic layer deposition (ALD) reactor without exposing the powder to air. Inside ALD reactor tungsten powder was exposed to 100 cycles of alternative pulses of scandium precursor ($Sc(thd)_3$, thd=2,2,6,6-tetramethyl-3,5-heptanedione) and ozone (FIG. 3B). As a result, all of the tungsten particles were coated with scandium oxide film having thickness of about 10 nm to form a $W/Sc_2O_3$ powder. In the next step (FIG. 3C), the $W/Sc_2O_3$ powder was placed in a die and was compacted without exposure to air into a cylinder having a diameter of 10 mm diameter and a height of 2 mm. In addition, a cylinder of an emissive mixture comprising BaO, CaO, and $Al_2O_3$ was compacted from an emissive mixture powder, and the two compacted cylinders were placed in contact with each other inside a high pressure cell, which was placed inside a high pressure apparatus (FIG. 3D). Pressure of 0.5 GPa was applied to the samples and they were heated to temperature of about 1750° C. to cause the emissive mixture to melt and impregnate the porous $W/Sc_2O_3$ compact. The sample was then cooled and the pressure released. The resulting sample of scandate cathode had a diameter of 9.5 mm and a height of 1.8 mm and had the structure shown in FIG. 3E, i.e., a $W/Sc_2O_3$ compact impregnated with the $BaO—CaO—Al_2O_3$ mixture. The resulting structure provided good uniformity of electron emission.

Although particular embodiments, aspects, and features have been described and illustrated, it should be noted that the invention described herein is not limited to only those embodiments, aspects, and features but also contemplates any and all modifications within the spirit and scope of the underlying invention described and claimed herein that may be made by persons skilled in the art, and all such embodiments are within the scope and spirit of the present disclosure.

What is claimed is:

1. A process for making a thermionic dispenser cathode from a scandium-coated powder, the process including:

providing a starting powder comprising particles of a refractory metal and/or metal alloy;

placing the starting powder inside a furnace having a controlled atmosphere and heating the starting powder in the flow of hydrogen or hydrogen/inert gas mixture to reduce surface oxides to produce a cleaned starting powder;

without exposing the cleaned starting particle to an external atmosphere, placing the cleaned starting powder inside a particle atomic layer deposition (ALD) reactor and controllably depositing a conformal nanometer-scale film of a scandium compound on the surface of all particles of the starting powder to produce a scandium-coated (Sc-coated) powder comprising the particles of the starting powder with a conformal nanometer-scale scandium film having a predetermined thickness uniformly deposited on all of the particles thereof;

placing the Sc-coated powder in contact with an emissive mixture;

without exposing the Sc-coated powder contacted with the emissive mixture to the air, applying a predetermined pressure P to the Sc-coated powder at room temperature to form a porous compact from the Sc-coated powder, wherein the pressure P is sufficient to break the scandium film on the surface of the Sc-coated particles so that the particles make electrical contact with one another but not high enough to cause the compact to lose porosity, the compact being in contact with the emissive mixture; and without exposing the porous compact in contact with the emissive mixture to air, heating the compact and the emissive mixture to a predetermined temperature T greater than a melting point of the emissive mixture so that the emissive mixture becomes a molten emissive mixture that impregnates the porous compact;

wherein the impregnated compact forms the cathode.

2. The process according to claim 1, wherein the refractory metal and/or metal alloy is tungsten.

3. The process according to claim 1, wherein the scandium compound is scandium oxide.

4. The process according to claim 1, wherein the emissive mixture is barium-calcium-aluminate.

5. The process according to claim 1, wherein the emissive mixture is a barium compound.

6. The process according to claim 1, wherein the emissive mixture comprises barium oxide calcium oxide, or aluminum oxide.

7. The process according to claim 1, wherein the pressure P is between about 0.1 and 5 GPa.

8. The process according to claim 1, wherein the temperature T is between 1500° C. and 2100° C.

9. A process for making a thermionic dispenser cathode from a scandium- and barium-coated powder, the process including:

providing a starting powder comprising particles of a refractory metal and/or metal alloy;

placing the starting powder inside a furnace having a controlled atmosphere and heating the starting powder in the flow of hydrogen or hydrogen/inert gas mixture to reduce surface oxides to produce a cleaned starting powder;

without exposing the cleaned starting powder to an external atmosphere, placing the cleaned starting powder inside a particle atomic layer deposition (ALD) reactor and controllably depositing a conformal nanometer-scale film of a scandium compound on the surface of all particles of the starting powder to produce a scandium-coated (Sc-coated) powder comprising the particles of the starting powder with a conformal nanometer-scale scandium film having a predetermined thickness uniformly deposited on all of the particles thereof;

with the Sc-coated powder still in the ALD reactor and without exposing the Sc-coated powder to the atmosphere, further controllably depositing a conformal layer of a barium compound on the Sc-coated powder to form a scandium- and barium-coated (Sc/Ba-coated) powder;

without exposing the Sc/Ba-coated powder to the atmosphere, applying a predetermined pressure P to the Sc/Ba-coated powder at room temperature to form a porous compact from the Sc/Ba-coated powder, wherein P is sufficient to break the Sc/Ba film on the surface of the coated particles so that the particles make electrical contact with one another but not high enough to cause the compact to lose porosity; and without exposing the porous compact to air, heating the porous compact to a predetermined temperature T at pressure P to sinter the porous compact to a dense compact, wherein the dense compact does not have a connected porosity or a porosity of less than 15%;

wherein the dense compact forms the cathode.

10. The process according to claim 9, wherein the refractory metal and/or metal alloy is tungsten.

11. The process according to claim 9, wherein the scandium compound is scandium oxide.

12. The process according to claim 9, wherein the barium compound is barium-calcium-aluminate.

13. The process according to claim 9, wherein the pressure P is between about 0.1 and 5 GPa.

14. The process according to claim 9, wherein the temperature T is between 800° C. and 2100° C.

* * * * *